US005842590A

United States Patent [19]

Gordon et al.

[11] Patent Number: 5,842,590

[45] Date of Patent: Dec. 1, 1998

[54] BI-NESTABLE MARGARITA GLASS APPARATUS AND METHOD

[75] Inventors: David Gordon, Groton; James J. Falzarano, Melrose; Albert F. Madonna, Tyngsboro, all of Mass.

[73] Assignee: WNA Comet East, Inc., Chelmsford, Mass.

[21] Appl. No.: 691,215

[22] Filed: Aug. 1, 1996

[51] Int. Cl.[6] ..... A47G 19/23

[52] U.S. Cl. ..... 215/10; 215/377; 206/509; 220/630

[58] Field of Search ..... 215/374, 376, 215/377, DIG. 7, 10; 220/630, 628; 206/509, 505

[56] References Cited

U.S. PATENT DOCUMENTS

| | | | |
|---|---|---|---|
| 83,341 | 10/1868 | Towndrow | 215/377 |
| 600,427 | 3/1898 | Jones, Jr. | 215/377 |
| 809,567 | 1/1906 | Henckel | 215/377 |
| 2,169,426 | 8/1939 | Morton | 65/66 |
| 2,585,445 | 2/1952 | Dingeldein | 220/630 X |
| 2,918,188 | 12/1959 | Todd | 215/99.5 |
| 2,996,208 | 8/1961 | Schroeder | 215/377 |
| 3,079,037 | 2/1963 | Schechter | 220/630 X |
| 3,089,605 | 5/1963 | Buonauro | 215/377 |
| 3,482,731 | 12/1969 | Douty | 220/69 |
| 3,526,335 | 9/1970 | Swett et al. | 215/377 X |
| 3,987,930 | 10/1976 | Fuson | 206/509 X |

FOREIGN PATENT DOCUMENTS

| | | | |
|---|---|---|---|
| 961785 | 1/1975 | Canada | 206/505 |
| 1236001 | 6/1960 | France | 215/374 |
| 2282051 | 11/1990 | Japan | 220/630 |

*Primary Examiner*—Sue A. Weaver
*Attorney, Agent, or Firm*—Pearson & Pearson

[57] ABSTRACT

An apparatus and method for providing a two-piece, plastic, container particularly attractive for serving Margarita drinks and other well-known cocktails. A receptacle portion includes double flared side walls with a two-stage tapered plug on the bottom. The upper-stage of the plug secures the receptacle in a base portion and the lower stage of the plug provides for nesting of a plurality of receptacles to provide a compact and secure arrangement when packaged for shipping. A base portion supports the receptacle portion and individual base portions are nestable.

19 Claims, 6 Drawing Sheets

BI-NESTABLE MARGARITA GLASS APPARATUS AND METHOD

BACKGROUND OF THE INVENTION

1. Field of the Invention

This invention relates to a container for drinks or cocktails and in particular to a two-piece, plastic, disposable, attractive double-flared container for serving a margarita or similar drinks.

2. Description of Related Art

In the prior art certain style containers have become associated with particular drinks such as for water, wine, beer, cocktails, etc. Other containers are used for packaging edible products and the cover is designed to function as a support base for a receptacle.

U.S. Pat. No. 2,918,188 issued Dec. 22, 1959 to B. K. Todd discloses an elongated container having a removable base with four depending teeth or tongs. U.S. Pat. No. 2,966,208 issued Mar. 29, 1961 to Paul A. Schroeder discloses an elongated container having members which may be used as a lid or a support base. U.S. Pat. No. 3,089,605 issued May 14, 1963 to Frank A. Bounauro discloses a two-part convertible container with a dual purpose as a storage vessel and also as a serving vessel. However, none of the above patents disclose an attractive double-flared receptacle, which is intended for serving a cocktail such as a margarita or other similar cocktail having a dual stage plug at a lower end that enables the packaging of a plurality of receptacles in a nesting configuration that minimizes or eliminates damage to the receptacles during shipment.

SUMMARY

Accordingly, it is therefore an object of this invention to provide a low cost, two-piece container having a double-flared receptacle portion with a two-stage plug on the bottom and a support base portion with a receiving socket for the plug.

It is an object of this invention to provide a low cost, plastic container having pieces which are nestable for safe, compact shipping purposes.

It is still another object of this invention to provide a receptacle portion of a container having a two-stage plug on the bottom, the lower stage being used for nesting a plurality of the receptacles for safe packaging and shipping.

It is another object of this invention to provide a two-piece container with support bases of different heights such as a tall base and a short base.

It is yet another object of this invention to provide a very attractive double-flared serving vessel for cocktails such as a margarita.

The objects are further accomplished by providing a two piece container for serving drinks comprising a receptacle having an open top and a closed bottom with a sidewall of varying diameter between the open top and the closed bottom, a base means for supporting the receptacle, and the bottom of the receptacle comprises a tapered plug having an upper stage means for securing the receptacle to the base and a lower stage means having a smaller diameter than the upper stage means for providing nesting of a plurality of the receptacles when separated from the base means. The container comprises plastic material. The base means comprises a stem which includes an open cylindrical top portion having a smaller diameter than a lower portion of the stem. The lower portion of the stem being tapered from an upper smaller diameter to a lower larger diameter. The tapered stem of the receptacle being nestable when separated from the container by positioning a plurality of stems, one inside the other, each of the plurality of stems having stop means inside the stem protruding radially a predetermined distance toward the center of the hollow stem. The nesting of the plurality of the receptacles when separated from the base means comprises inserting the lower stage means of one of the plurality of the receptacles into the upper stage means of another of the plurality of the receptacles.

The objects are further accomplished by providing a two piece container for serving a margarita drink and other cocktails or food comprising a receptacle having an open top and a closed bottom with a double-flared sidewall of varying diameter in between the open top and the closed bottom, the diameter of the open top of an upper-flared portion of the receptacle being greater than the diameter of the top of a lower-flared portion which is greater than the diameter of the bottom, a base means for supporting the receptacle, and the bottom of the receptacle comprises a tapered plug having an upper stage for securing the receptacle to the base means and a lower stage having a smaller diameter than the upper stage for providing nesting of a plurality of the receptacles when separated from the base means. The base means comprises a stem which includes an open cylindrical top portion having a smaller diameter than a lower portion of the stem. The lower portion of the stem being tapered from an upper smaller diameter to a lower larger diameter. The nesting of the plurality of the receptacles when separated from the base means comprises inserting the lower stage means of one of the plurality of the receptacles into the upper stage means of an adjacent one of the plurality of the receptacles.

The objects are further accomplished by a method of providing a two piece container for serving drinks comprising the steps of providing a receptacle having an open top and a closed bottom with a sidewall of varying diameter between the open top and the closed bottom, supporting the receptacle with a base means, and securing the receptacle to the base with an upper stage of a tapered plug on the bottom of the receptacle, a lower stage means of the plug having a smaller diameter than the upper stage means for providing nesting of a plurality of the receptacles when separated from the base means. The method includes providing the container comprising the receptacle and the base means made of plastic material. The step of the base means supporting the receptacle comprises the step of providing the base means with a stem which includes an open cylindrical top portion having a smaller diameter than a lower portion of the stem. The step of the base means supporting the receptacle includes the step of providing the lower portion of the tapered stem with an upper smaller diameter extending to a lower larger diameter. The step of providing the tapered stem further comprises the step of nesting a plurality of the stems when separated from the receptacle by positioning the plurality of stems, one inside the other, each of the plurality of stems having stop means inside the stem protruding radially a predetermined distance toward the center of the hollow stem. The step of securing the receptacle to the base means with the tapered plug includes the step of providing the lower stage means of the plug for enabling the nesting of a plurality of the receptacles when the receptacle is separated from the container. The step of providing nesting of a plurality of the receptacles when separated from the container comprises the step of inserting the lower stage means of one of the plurality of the receptacles into the upper stage means of an adjacent one of the plurality of the receptacles.

The objects are further accomplished by a method of providing a two piece container for serving a margarita drink and other cocktails or food comprising the steps of providing a receptacle having an open top and closed bottom with a double-flared sidewall of varying diameter between the open top and the closed bottom, the diameter of the open top of an upper-flared portion of the receptacle being greater than the diameter of the top of a lower-flared portion which is greater than the diameter of the bottom, supporting the receptacle with a base means, and securing the receptacle to the base means with an upper stage of a tapered plug and a lower stage of the tapered plug having a smaller diameter than the upper stage for providing nesting of a plurality of the receptacles when separated from the base means.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
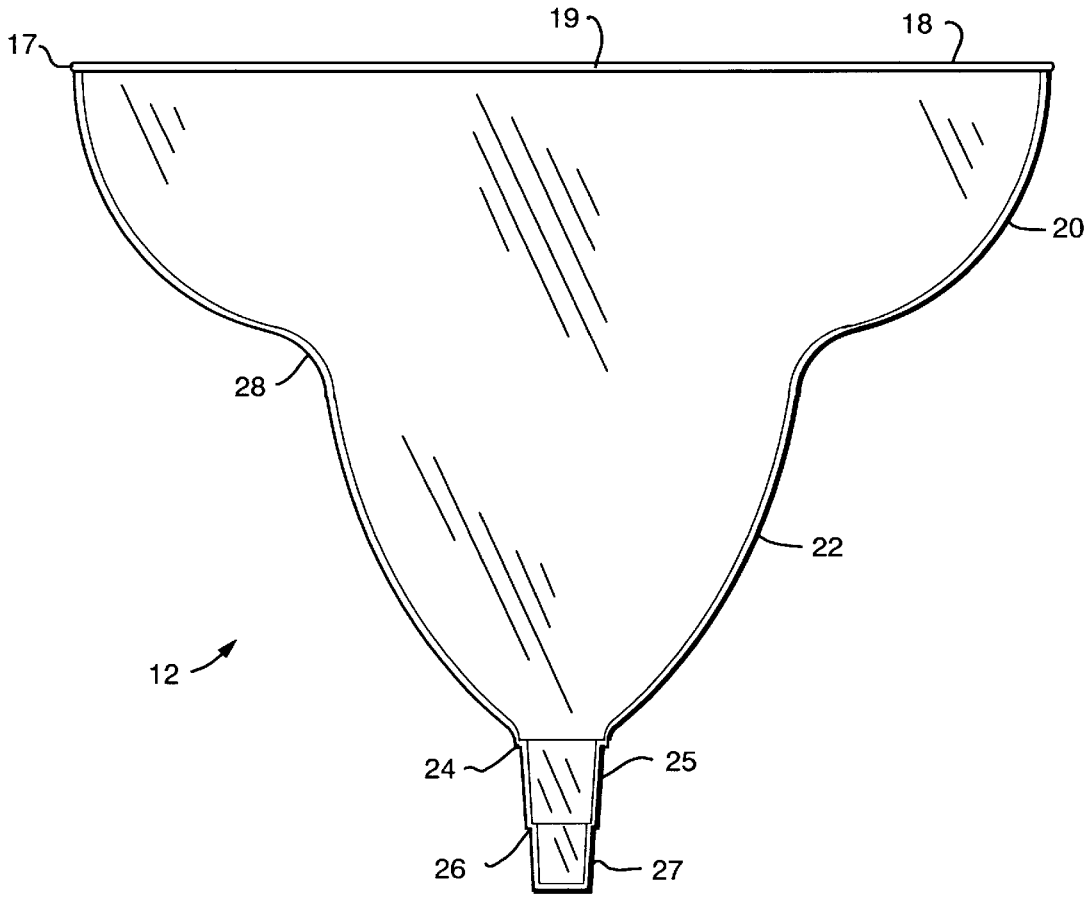
FIG. 1 is a side elevational view of a receptacle portion of the invention.
Figure 2:
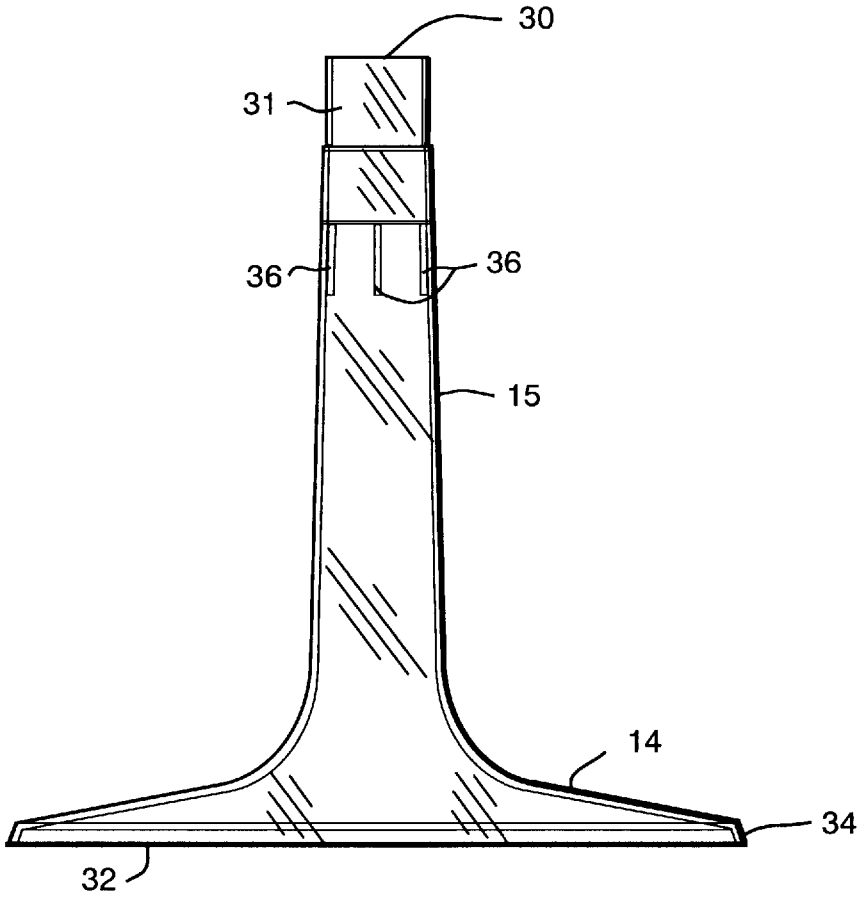
FIG. 2 is a side elevational view of a first embodiment of a tall support base portion of the invention.
Figure 3:
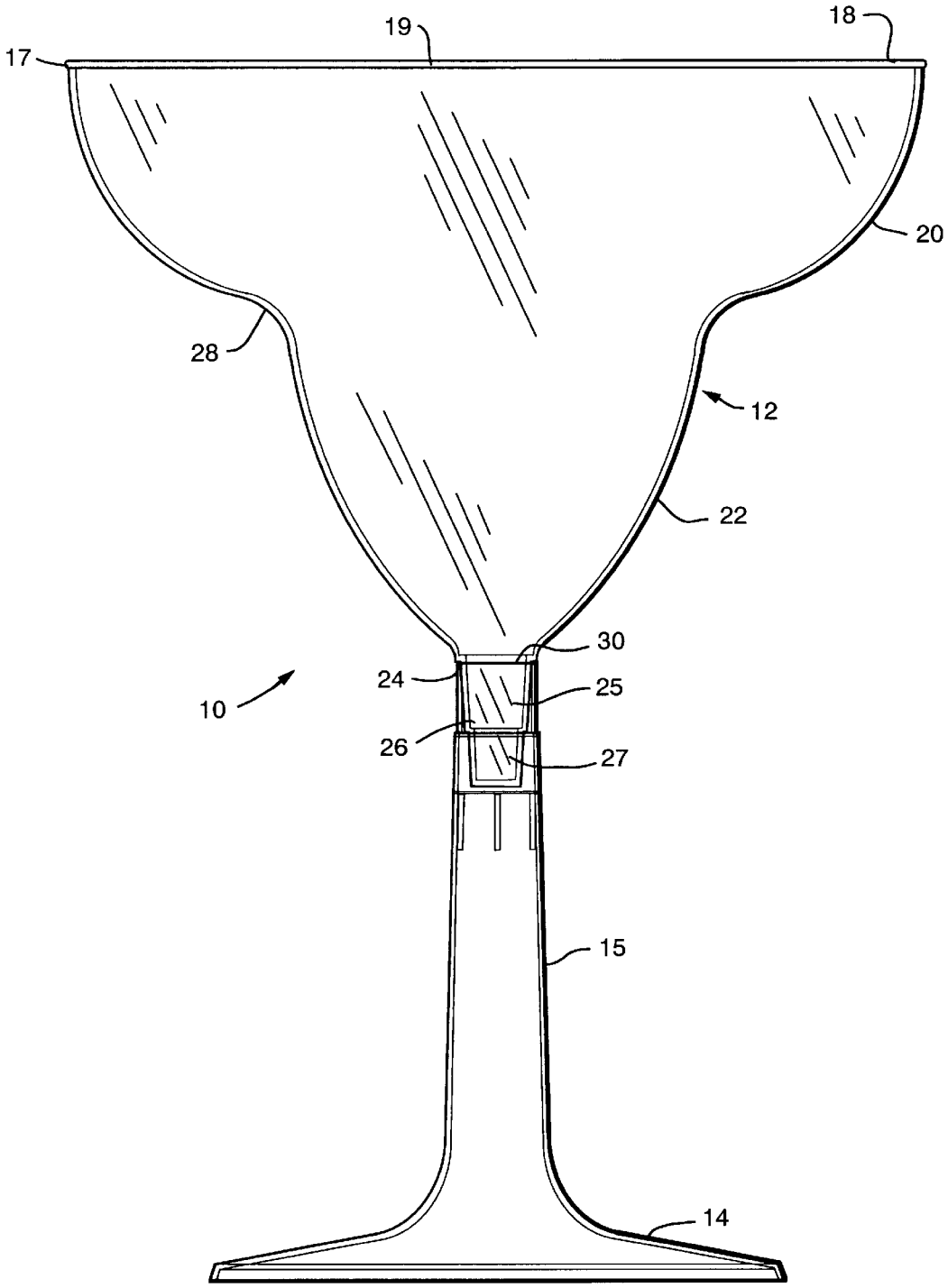
FIG. 3 is a side elevational view illustrating the receptacle of FIG. 1 supported on base of FIG. 2.

Referring to FIG. 1, FIG. 2 and FIG. 3, FIG. 3 shows a side elevational view of the invention of a cocktail container 10 comprising a receptacle 12 supported by a tall support base 14. FIG. 2 is a side elevational view of the tall support base 16. FIG. 1 shows a side elevational view of the receptacle 12 which includes double-flared or teardrop shaped side walls 20, 22 which converge downward from an open end 18 to a lower end 24 and terminates in a downwardly projection dual stage tapered plug 26. Such a double-flared or teardrop shaped receptacle 12 is often referred to as a "Margarita glass" even though it may not be made of glass and also referred to as "Margarita Stemware". The container 10 is used for other types of drinks such as "island" drinks and other similar cocktails or "frozen" drinks and further may be used for serving appetizers such as shrimp cocktails and desserts.

Figure 4:
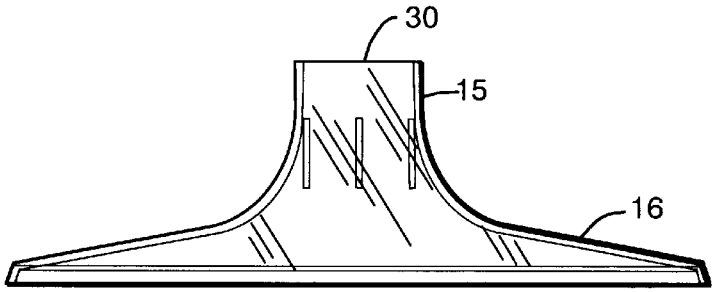
FIG. 4 is a side elevational view of a second embodiment of a short support base portion of the invention.
Figure 6:
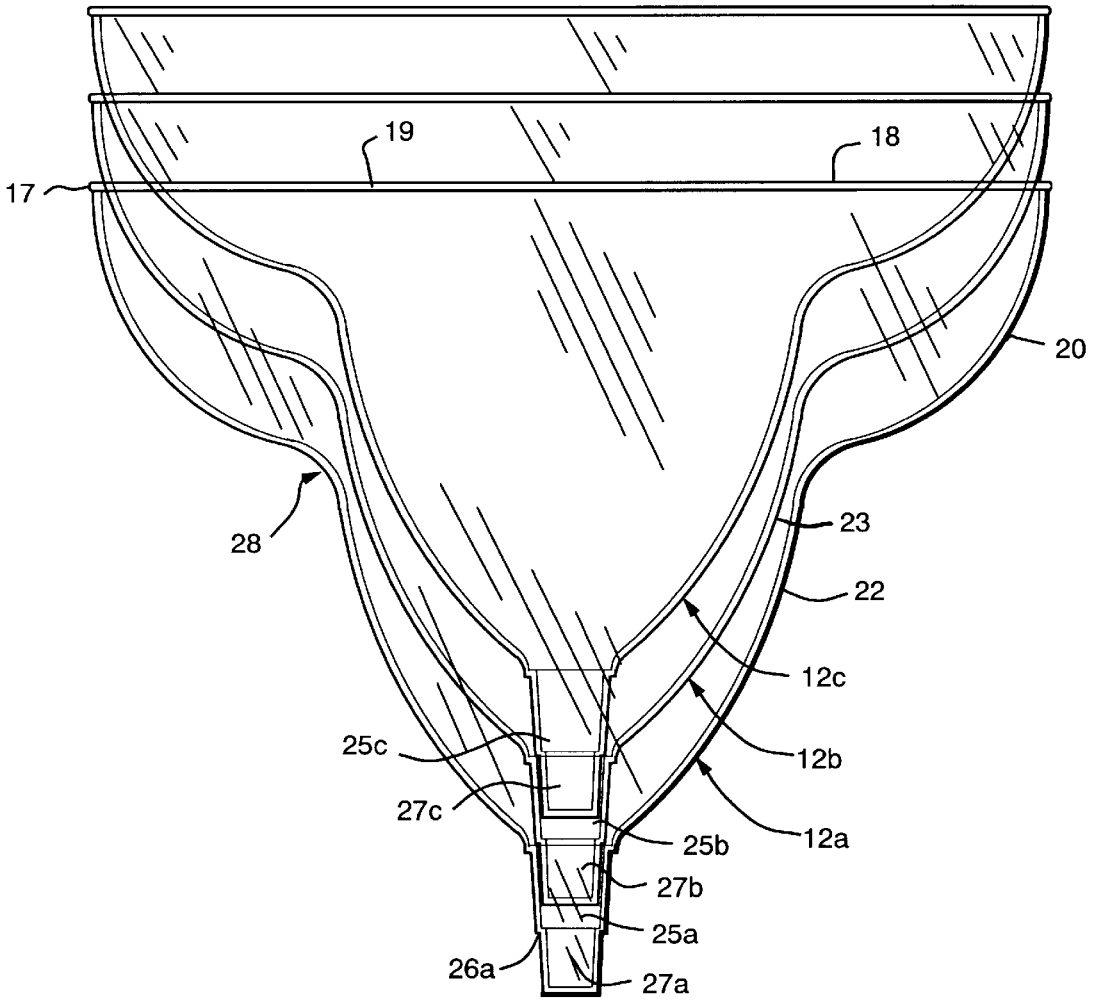
FIG. 6 is a side elevational view showing the nesting of three receptacles by means of the lower stage of the tapered plug of the receptacle.
Figure 7:
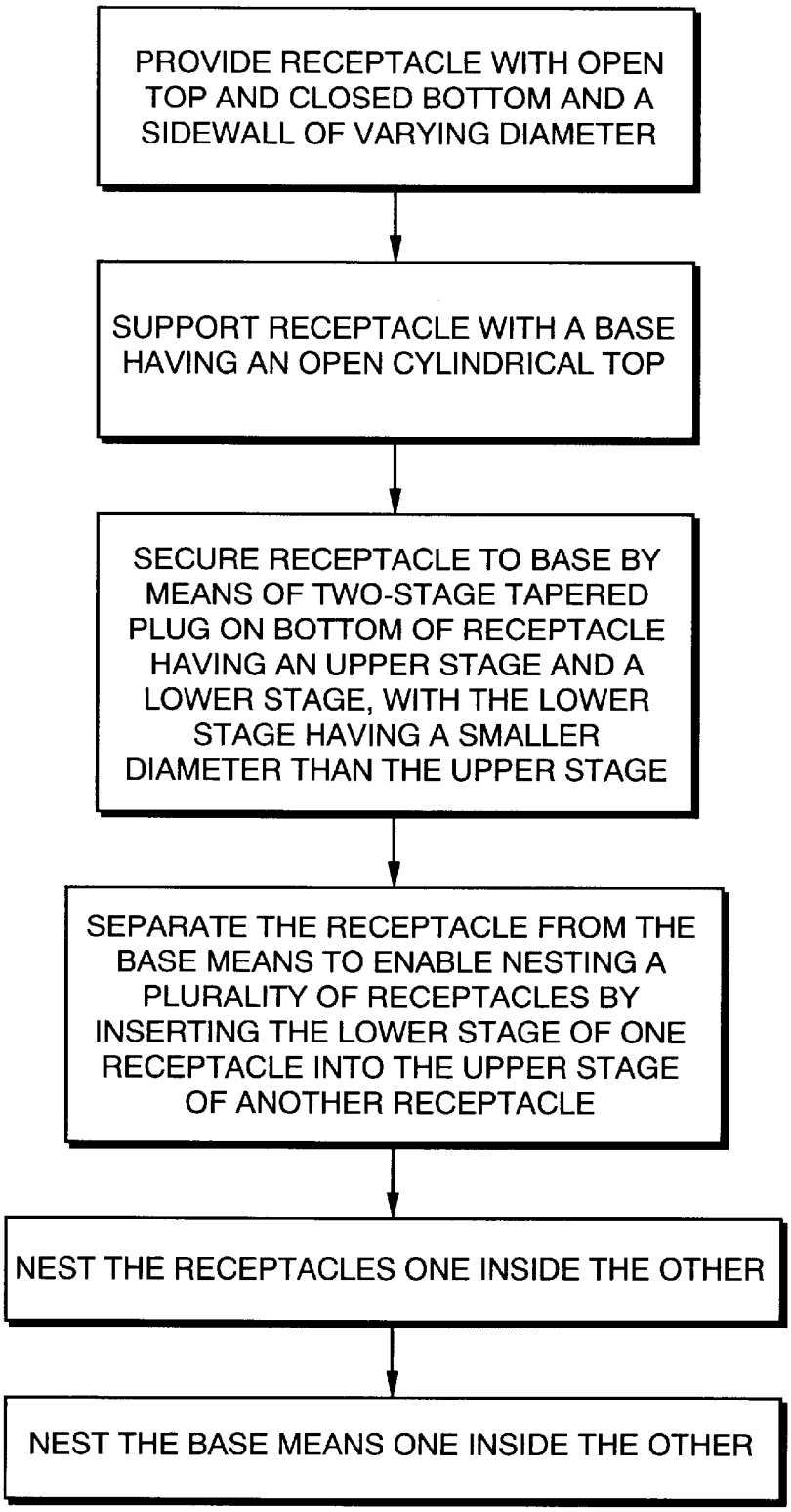
FIG. 7 is a flow diagram of the steps for the method of providing a two-piece container having nestable portions for serving drinks or for serving food.

Referring now to FIG. 1, FIG. 2, and FIG. 4, the upper stage 25 and lower stage 27 of plug 26 are each slightly tapered and the upper stage 25 is approximately ⅜ inch long and the lower stage 27 is approximately ¼ inch long although other lengths are equally feasible. The tapering of upper stage 25 facilitates a tight fit when the plug 26 is inserted into the open end of socket 30 of base 14 and base 16 and the tapering of the lower stage 27 facilitates a secure fit when the receptacles 12 are nested or stacked for packaging and shipping as shown in FIG. 6.

Referring again to FIG. 1, the top of the upper flared portion formed by side wall 20 of receptacle 12 comprises the open end 18. The transition point 28 or top of the lower flared portion formed by sidewall 22, which resembles a truncated ellipse, is approximately one-half of the diameter of the open end 18, although other various diameters for the open end 18 and the transition point 28 are equally feasible. The preferred embodiment of the invention is fabricated from inexpensive material such as polystyrene plastic which provides thin but sturdy walls 20, 22. The upper peripheral edge 17 of the cocktail container 10 is provided with an overhang or outwardly projecting, continuous lip or bend 19.

Referring again to FIG. 2, an embodiment of a tall support base 14 is shown. The upper end 30 of the base 14 is open and functions as a socket for receiving the dual stage tapered plug 26 of the receptacle 12. The neck 31 of the base 14 is slightly narrower than the remainder of the stem 15 which tapers outward moving downward to a lower end 32 which flares out to provide a stable base. The lower end 32 is open and dimensioned to provide a stable cocktail container 10. The diameter of the lower end 32 is approximately midway between the diameter of the open end 18 of the receptacle 12 and the diameter of the transition point 28 at the top of the lower flared portion formed by sidewall 22. The lower end 32 of the base 14 is provided with a downwardly turned peripheral edge or skirt 34. The base is fabricated from plastic like the receptacle 12.

Referring to FIG. 3, the side view of the cocktail container 10 is shown with the receptacle 12 of FIG. 1 supported on the base 14 of FIG. 2. The receptacle 12 of FIG. 1 may also be supported on a short stem support base 16 as shown in FIG. 4. The tapered upper stage 25 of the plug 26 provides a tight connection for stability between the receptacle 12 and the base 14. The lower stage 27 does not contact the side of the base 14. The primary function of the lower stage 27 is to enable safe nesting of a plurality of the receptacles 12 for efficient packaging and nonbreakage during shipping as shown in FIG. 6.

Figure 5:
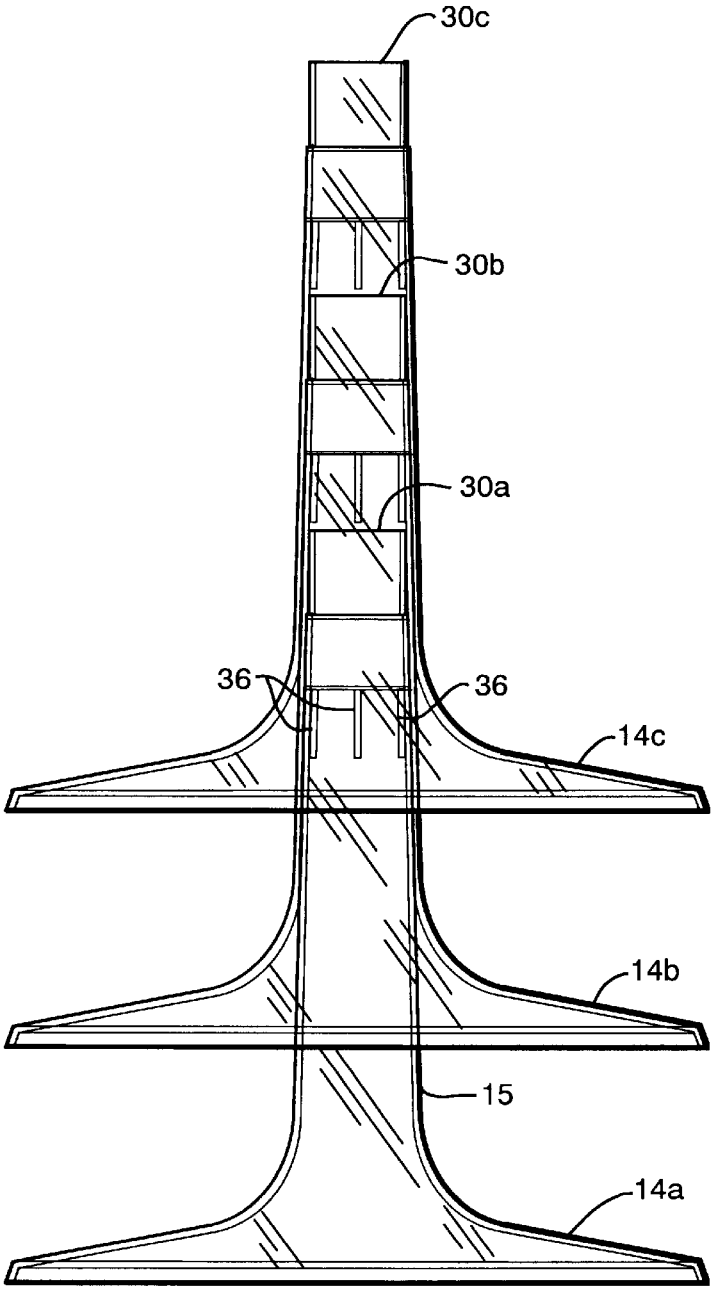
FIG. 5 is a side elevational view of three tall nested support bases.

Referring now to FIG. 4 and FIG. 5, FIG. 4 shows a side elevational view of an embodiment of the short support base 16. The stem 15 is reduced to be approximately two inches shorter than the stem of the base 14 shown in FIG. 2. In all other respects both bases 14, 16 are the similar.

Referring now to FIG. 5, three tall support bases 14*a*, 14*b*, 14*c* are shown nested one on top of the other, each having an upper end 30*a*, 30*b* and 30*c* respectively. Four vertical stops 36 are positioned every 90 degrees around the inside wall of each tall base 14*a*, 14*b*, 14*c* approximately 0.5 inches below the upper end 30*a* of the base 14*a*. The stops 36 limit the distance that base 14*a* can be inserted in another base 14*b* and so on. By maintaining a distance between the bases 14*a*, 14*b* and 14*c* in such a nesting configuration, any damage to said bases as a result of packaging and shipping is essentially eliminated.

Referring now to FIG. 6, the nesting of several receptacles 12*a*, 12*b*, 12*c* is shown. The lower stage 27*b* of receptacle 12*b* is inserted into the upper stage 25*a* of a plug 26*a* of receptacle 12*a* and causes the receptacle 12*b* to be centrally positioned whereby the sides 22 and 23 of receptacles 12*a* and 12*b* do not touch each other. Likewise, the lower stage 27*c* of receptacle 12*c* is inserted into the upper stage 25*b* of receptacle 12*b*. A continuous plurality of receptacles may continue to be nested, limited only by the size of a packaging container. Hence, upper stage 25*c* may receive a lower stage of another receptacle. Having the lower stages 27*a*, 27*b*, 27*c* etc. on each receptacle is a significant advantage in order to prevent damage to the receptacles, especially during shipping or transporting of packaged receptacles.

This invention has been disclosed in terms of certain embodiments. It will be apparent that many modifications can be made to the disclosed apparatus without departing from the invention. For example, the sizes of the receptacles 12 and the height of the support bases 14, 16 may vary. It may also be apparent that the subject container may have other applications besides serving drinks such as serving ice cream or serving shrimp by placing shrimp cocktail sauce in the bottom section of the receptacle and hanging shrimp around the peripheral top edge of the container. Therefore, it is the intent of the appended claims to cover all such variations, modifications and uses as come within the true spirit and scope of this invention.

What is claimed as new and desired to be secured by Letters Patent of the United States is:

1. A two piece container for serving drinks comprising:

a receptacle having an open top and a closed bottom with a sidewall of varying diameter between said open top and said closed bottom;

a base means for supporting said receptacle; and said bottom of said receptacle comprises a tapered plug having an upper stage means for securing said receptacle to said base means and a lower stage means having a smaller diameter than said upper stage means for providing stable nesting of a plurality of receptacles when separated from said base means without said sidewalls of said receptacles touching each other.

2. The container as recited in claim 1 wherein said container comprises plastic material.

3. The container as recited in claim 1 wherein said base means comprises a stem which includes an open cylindrical top portion having a smaller diameter than a lower portion of said stem.

4. The container as recited in claim 3 wherein said lower portion of said stem being tapered from an upper smaller diameter to a lower larger diameter.

5. The container as recited in claim 4 wherein said stem of said base means being nestable when separated from said receptacle by positioning a plurality of stems, one inside the other, each of said plurality of stems having stop means inside said stem protruding radially a predetermined distance toward the center of said stem.

6. The container as recited in claim 1 wherein said receptacle sidewalls are of a shape such that said nesting of said plurality of said receptacles when separated from said base means comprises inserting said lower stage means of one of said plurality of said receptacles into said upper stage means of another of said plurality of said receptacles.

7. A two piece container for serving cocktails including a margarita drink or for serving food comprising:

a receptacle having an open top and a closed bottom with a double-flared sidewall of varying diameter in between said open top and said closed bottom;

said diameter of said open top of an upper-flared portion of said receptacle being substantially greater than the diameter of the top of a lower-flared portion which is greater than the diameter of said bottom;

a base means for supporting said receptacle; and said bottom of said receptacle comprises a tapered plug having an upper stage for securing said receptacle to said base means and a lower stage having a smaller diameter than said upper stage for providing stable nesting of a plurality of receptacles when separated from said base means without said sidewalls of said plurality of receptacles touching each other.

8. The container as recited in claim 7 wherein said container comprises plastic material.

9. The container as recited in claim 7 wherein said base means comprises a stem which includes an open cylindrical top portion having a smaller diameter than a lower portion of said stem.

10. The container as recited in claim 9 wherein said lower portion of said stem being tapered from an upper smaller diameter to a lower larger diameter.

11. The container as recited in claim 10 wherein said tapered stem being nestable when separated from said receptacle by positioning a plurality of stems, one inside the other, each of said plurality of stems having stop means inside said stem for limiting the distance each stem can protrude into the other stem.

12. The container as recited in claim 7 wherein said receptacle sidewalls are of a shape such that said nesting of said plurality of said receptacles when separated from said base means comprises inserting said lower stage means of one of said plurality of said receptacles into said upper stage means of an adjacent one of said plurality of said receptacles.

13. A method of providing a two piece container for serving drinks comprising the steps of:

providing a receptacle having an open top and a closed bottom with a sidewall of varying diameter between said open top and said closed bottom;

supporting said receptacle with a base means; and securing said receptacle to said base means with an upper stage means of a tapered plug on the bottom of said receptacle, a lower stage means of said plug having a smaller diameter than said upper stage means for providing stable nesting of a plurality of receptacles when separated from said base means without said sidewalls of said plurality of receptacles touching each other.

14. The method as recited in claim 13 wherein said method includes providing said container comprising said receptacle and said base means made of plastic material.

15. The method as recited in claim 13 wherein said step of said base means supporting said receptacle comprises the step of providing said base means with a stem which includes an open cylindrical top portion having a smaller diameter than a lower portion of said stem.

16. The method as recited in claim 15 wherein said step of said base means supporting said receptacle includes the step of providing said lower portion of said tapered stem with an upper smaller diameter extending to a lower larger diameter.

17. The method as recited in claim 16 wherein said step of providing said tapered stem further comprises the step of nesting a plurality of said stems when separated from said receptacle by positioning said plurality of stems, one inside the other, each of said plurality of stems having stop means inside said stem protruding radially a predetermined distance toward the center of said stem.

18. The method as recited in claim 13 wherein said receptacle sidewalls are of a shape such that said nesting of a plurality of receptacles when separated from said base means comprises the step of inserting said lower stage means of one of said plurality of said receptacles into said upper stage means of an adjacent one of said plurality of said receptacles.

19. The method of providing a two piece container for serving a cocktail including a margarita drink or food comprising the steps of:

providing a receptacle having an open top and closed bottom with a double-flared sidewall of varying diameter between said open top and said closed bottom, said diameter of said open top of an upper-flared portion of said receptacle being substantially greater than the diameter of the top of a lower-flared portion which is greater than the diameter of said bottom;

supporting said receptacle with a base means; and securing said receptacle to said base means with an upper stage of a tapered plug and a lower stage of said tapered plug having a smaller diameter than said upper stage for providing nesting of a plurality of receptacles when separated from said base means without said sidewalls of said plurality of receptacles touching each other.

* * * * *